United States Patent [19]

Adams

[11] 4,204,598

[45] May 27, 1980

[54] VASE HOLDER

[75] Inventor: Michael G. Adams, Westland, Mich.

[73] Assignee: Weyerhaeuser Company, Tacoma, Wash.

[21] Appl. No.: 44,275

[22] Filed: May 31, 1979

[51] Int. Cl.[2] ..... B65D 85/44; A47G 7/00; A47G 23/02

[52] U.S. Cl. ..... 206/426; 206/45.14; 215/100.5; 248/152; 248/346

[58] Field of Search ..... 206/426, 486, 45.14, 206/45.19; 215/100.5; 248/346, 346.1, 152

[56] References Cited

U.S. PATENT DOCUMENTS

| | | | |
|---|---|---|---|
| 3,002,609 | 10/1961 | Batkin | 206/45.14 |
| 3,297,289 | 1/1967 | Raus | 215/100.5 |
| 3,881,674 | 5/1975 | Greene | 248/346 |

*Primary Examiner*—William T. Dixson, Jr.

[57] ABSTRACT

A folder for holding a vase upright while it is being transported. The base of the vase is inserted into the device and held within the device during transportation.

7 Claims, 2 Drawing Figures

VASE HOLDER

BACKGROUND OF THE INVENTION

1. Field of the Invention

A vase package, or a folder for holding a vase upright while the vase is being transported.

2. Review of the Prior Art

It is necessary to provide some means of keeping the vases upright when transporting floral arrangements. The usual method of packaging vases of flowers today is a half-slotted container into which the vase is placed. Paper is used to pack the vase in the container.

SUMMARY OF THE INVENTION

The objects deemed necessary by the inventor in designing a package appropriate for use in the floral industry were that the package should require minimum room for storage prior to use, should be assembled easily for use, should not damage the flowers or the plants, should maintain the vases upright while being transported should be removed easily from the vase and should be disposable. This latter requirement is necessary because of the great number of these containers received by hospitals and funeral homes.

He developed a folder which surrounds and holds the base of the vase and into which the base may be inserted easily. The folder may also be removed easily from the vase. It may be stored in a lay flat condition prior to use and is disposable.

DESCRIPTION OF THE PREFERRED EMBODIMENT

Figure 1:
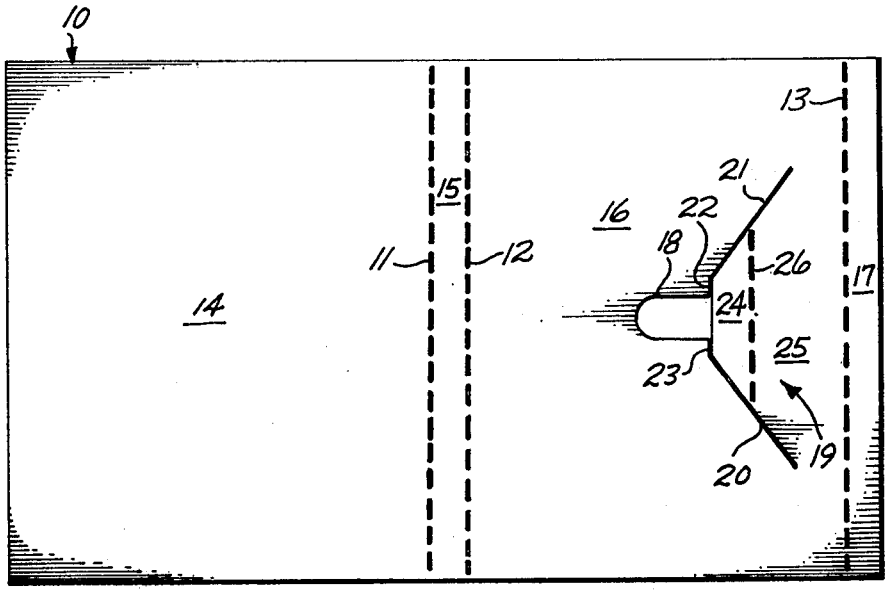
FIG. 1 shows the folder blank.
Figure 2:
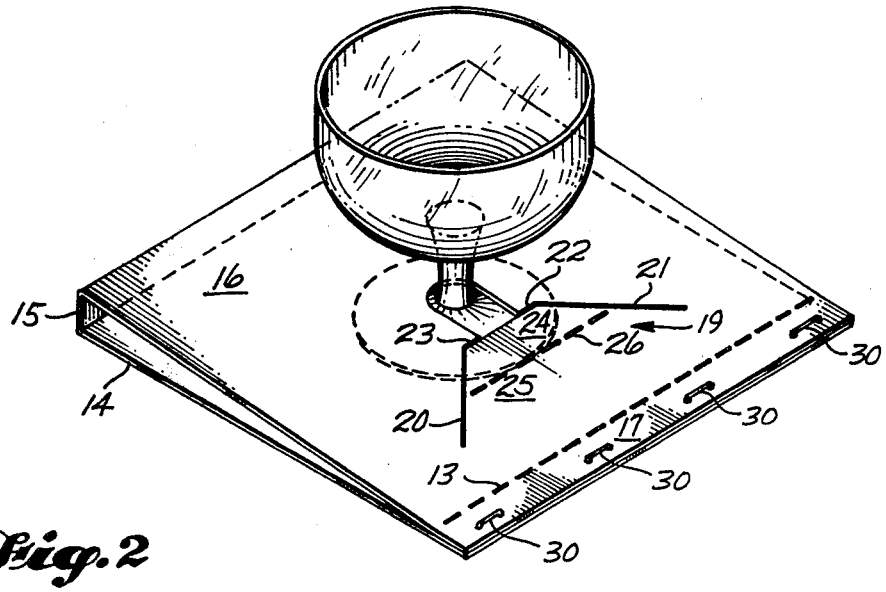
FIG. 2 shows the package, including the vase.

The blank 10 is divided by score lines 11, 12 and 13 into a bottom panel 14, an end panel 15, an upper panel 16 and a fastening panel 17.

The blank is formed into a support folder by being bent around score lines 11 and 12. The panel 17 is fastened to the outer end of panel 14. Staples 30 would normally be used. Score line 13 allows panel 17 to rest firmly against panel 14 when the two are fastened together.

An elongated slot 18 is located approximately in the center of upper panel 16. The end of the slot closest to score line 13 is formed by a trapezoidal shaped flap 19. This flap is formed in upper panel 16 by side slits 20 and 21 and end slits 22 and 23. The side slits are angled outwardly toward the score line 13 so that the larger base of the trapezoid is nearer the score line 13. The angle formed by the extension of the side slots and score line 13 is about 45°. The ends of the slot 18 may be either flat or curved. The flap 19 is divided into upper and lower sections 24 and 25 by score line 26.

The flap 19 allows the base of the vase to be inserted between the base panel 14 and the upper panel 16, and holds the vase within these panels. The vase stem extends through slot 18. When removing the vase from the container, the section 24 is grasped and pulled upwardly, pulling the flap 19 upwardly to allow the vase to be removed.

Since the package is made preferably of corrugated paperboard material, it may be burned.

What is claimed:

1. A folder blank comprising:

a bottom panel, an end panel and an upper panel, an elongated slot located centrally of said upper panel, the long dimension of said slot being in the lengthwise direction of said blank, the edge of said slot adjacent the free end of said upper panel being formed by the smaller parallel side of a trapezoidal flap, said flap being formed in said upper panel and being defined by side slits in said upper panel, said slits being angled outwardly towards the outer edge of said upper panel, said trapezoidal flap having a scoreline extending between said side slits to divide said flap into upper and lower trapezoidal sections and for reversely folding of the flap back for insertion of said article into said slot and permitting said flap to return to its normal position for blocking said slot.

2. The blank of claim 1 in which said sides slits are at an angle of about 45° to said free end.

3. The blank of claim 1 in which said side slits are of equal length.

4. The blank of claim 1 in which said blank has a scoreline adjacent the outer edge of said upper panel, said scoreline defining a fastening panel on the end of said upper panel.

5. A package comprising:

a vase, said vase having a stem and a base, a folder around said base, said folder having an upper panel over the top of said base, a bottom panel under said base, said stem extending through a central slot in said upper panel, the outer end of said slot being formed by the smaller parallel side of a trapezoidal flap in said upper panel, said trapezoidal flap being defined by side slits in said upper panel and having a score line extending between said side slits to divide said flap into upper and lower trapezoidal sections and for reversely folding of the flap back for insertion of said vase into said slot and permitting said flap to return to its normal position for blocking said slot.

6. The package of claim 5 wherein said side slits are angled outwardly towards the outer edge of said upper panel.

7. The package of claim 6 wherein said side slits are at an angle of about 45° to said free end.

* * * * *